US005203468A

United States Patent [19]

Hsu

[11] Patent Number: 5,203,468

[45] Date of Patent: Apr. 20, 1993

[54] WATER CONTAINER CAP

[76] Inventor: Chun-Feng Hsu, No. 31-13, Nung 55, Lane 274, Chung-Cheng South Road, Yung Kang Hsiang, Tainan Hsien, Taiwan

[21] Appl. No.: 907,067

[22] Filed: Jul. 1, 1992

[51] Int. Cl.[5] ..... B65D 51/18

[52] U.S. Cl. ..... 220/254; 220/707; 220/708; 220/705; 220/711; 222/527; 222/528; 222/529; 222/530

[58] Field of Search ..... 215/1 A, 229; 220/707, 220/708, 709, 705, 715, 714, 713, 711, 706, 694, 254, 212; 222/527, 528, 529, 530

[56] References Cited

U.S. PATENT DOCUMENTS 3,181,743 5/1965 Libit et al. ..... 222/530 X
3,392,887 7/1968 Bross ..... 222/530 X
4,440,327 4/1984 Dark ..... 222/530
4,448,316 5/1984 Hiroshige ..... 215/1 A
4,485,963 12/1984 Panicci ..... 215/1 A X
4,684,032 8/1987 Tsay ..... 215/1 A
4,726,479 2/1988 Tsai ..... 215/229

*Primary Examiner*—Stephen P. Garbe
*Assistant Examiner*—Paul A. Schwarz
*Attorney, Agent, or Firm*—Morton J. Rosenberg; David I. Klein

[57] ABSTRACT

A water container cap including a push button for closing and opening a cap member is provided. A nipple disposed in the cap body is pulled up by the cap member when it is opened, by pushing the push button inward within a recess formed in the cap body. The nipple is connected with a soft flexible sucking tube fluidly communicating with the interior of a water container to which the cap is coupled. In this manner, the liquid stored in the water container may be withdrawn by sucking through the nipple.

2 Claims, 3 Drawing Sheets

WATER CONTAINER CAP

BACKGROUND OF THE INVENTION

A conventional water container for children to carry, such as canteens, etc. generally has a threaded cap for engagement with a threaded top of the water container. This is not ideal, having the disadvantage that the cap must be screwed open to use, and screwed shut when not in use. Further, the cap is likely to be dropped or lost and the container nipple can become filthy.

SUMMARY OF THE INVENTION

This instant invention provides an improvement to a conventional water container cap by providing a cap having a cap body which always covers the open top of a water container, a cap member which is swingable up and down on the cap body, a movable nipple disposed in a hollow space in the cap body when the cap member is closed on the cap body, and a soft flexible sucking tube connected to the nipple and communicating with the interior of the water container. A push button is provided to be disposed in an opening in the cap body and a spring is mounted on one end within an opening in the cap body and on the opposing end, inside the push button to resiliently push the button back after it is pushed inward within the opening in the cap body. The cap member is kept closed by engagement with the push button, and opened by pushing the push button. When the cap member is opened, such pulls up the nipple for sucking, and pushes down the nipple in the cap body when it is closed.

BRIEF DESCRIPTION OF THE DRAWINGS

The invention will be better understood by reference to the accompanying drawings, wherein.

DETAILED DESCRIPTION OF THE PREFERRED EMBODIMENTS

Figure 1:
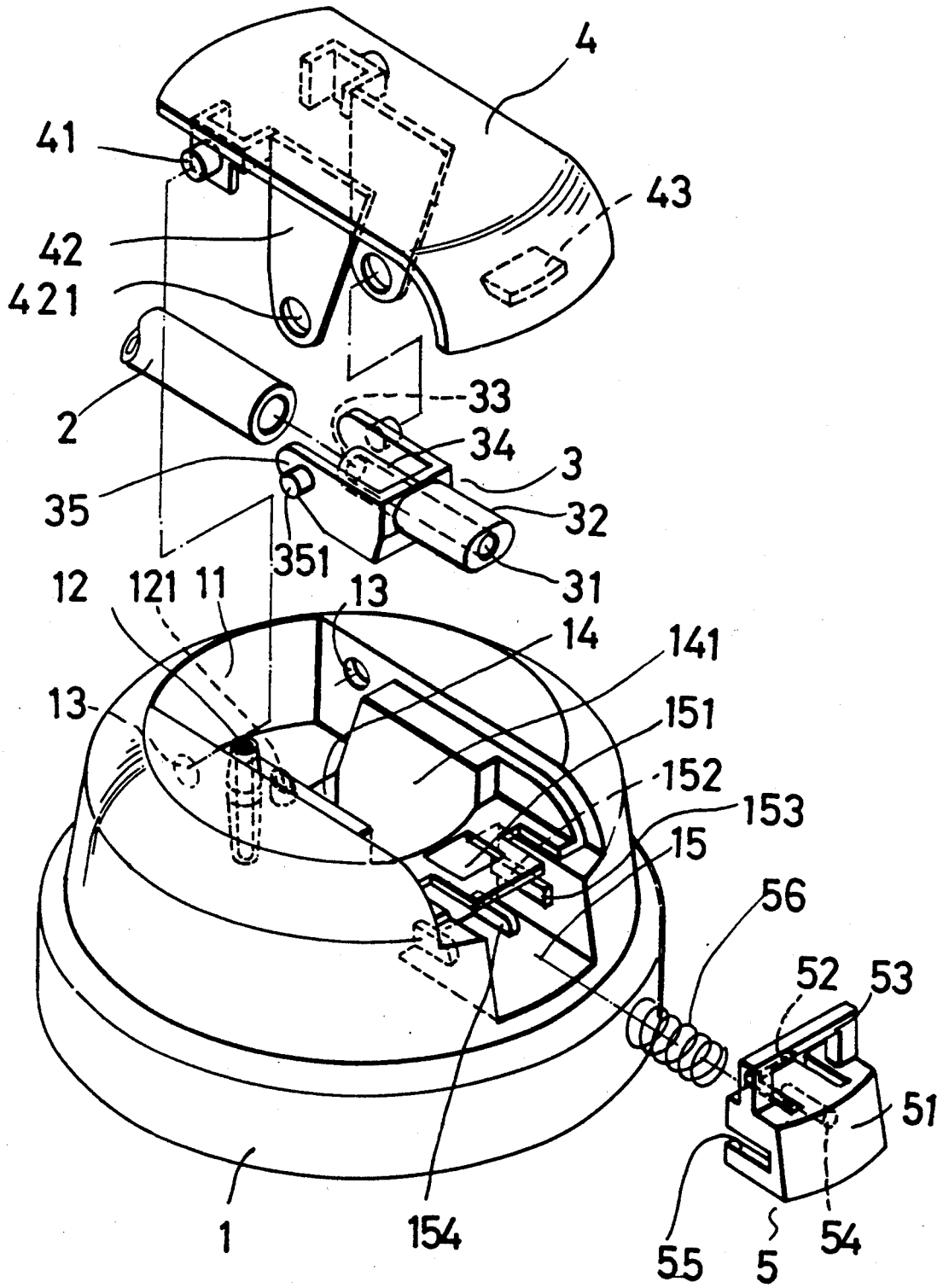
FIG. 1 is an exploded perspective view of a water container cap of the present invention.

The water container cap of the present invention, as shown in FIG. 1, comprises a cap body 1, a sucking tube 2, a nipple 3, a cap member 4 and a push button 5 as main components.

The cap body 1 has a recessed chamber 11, with an upright projection 12 disposed therein. The projection 12 is formed with a bore extending therethrough. The recessed chamber 11 is also formed with a post hole 121 formed through the cap body 1 near the projection 12, so as to permit air to enter the container as water is sucked therefrom. A pair of recessed openings 13 are formed in opposing sides of the recessed chamber 11, and a deep hollow space 14 is formed adjacent the recessed chamber 11. The hollow space 14 is bounded by two contact faces 141 formed on opposing sides thereof. A locating opening 15 is formed on the side of the cap body 1 opposite to the recessed chamber 11. A fixing plate 152 having a hole 151 covers the top of the opening 15. A pair of projecting ribs 153 are formed on opposing side walls of the opening 15 and a pair of spaced limit ribs 154 are formed on the bottom of the opening 15.

The sucking tube 2 is made of a soft flexible material, having one end fluidly coupled to the top of the projection 12 in the cap body 1, and the other end fluidly coupled to a rear portion of a nipple 3.

The nipple 3 is to be combined with the sucking tube 2 for sucking the liquid stored in the water container. The nipple 3 has a front portion 32 with a through hole 31, and a rear portion 34 having a through hole 33 extending therethrough and in fluid communication with through hole 31, rear portion 34 mating with one end of the sucking tube 2. Nipple 3 further includes a pair of projecting ears 35 on opposing sides thereof which define a U-shaped nipple support member, each ear 35 having a sideward extending projection 351.

The cap member 4 can be swung up and down by a pivot defined by a pair of projections 41 engaged within the holes 13 formed in the sides of the recessed opening 11 of the cap body 1. The cap member 1 includes two downwardly directed parallel arms 42, each having a hole 421 found therein, for receipt of respective projections 351 extending from the projecting ears 35 of the nipple 3. Cap member 4 includes an engaging block 43 formed on an inner wall of a front portion thereof, for engagement with an inverted U-shaped rod 53 formed on push button 5 to keep the cap member 4 closed until the push button is displaced.

The push button 5 is disposed in the opening 15 of the cap body 1. The push button 5 comprises a push block 51, dimensioned to fit in the opening 15 of the cap body 1 to keep the cap member 4 in a closed position. Push block 51 is formed with a hook 52 at one end to engage the opening 151 of fixing plate 152, and an inverted U-shaped rod 53 formed on an upper surface for engaging both block 43 of the cap member 4 and the fixing plate 152 of the cap body 1, the fixing plate 152 passes under the block 43 when the cap member 4 is closed. A locating post 54 extends from an inner wall of push block 51 for locating a spring 56 thereon. The push block is provided with two slots 55 formed in the sides thereof for respectively receiving the two limit ribs 154 therein.

Figure 2:
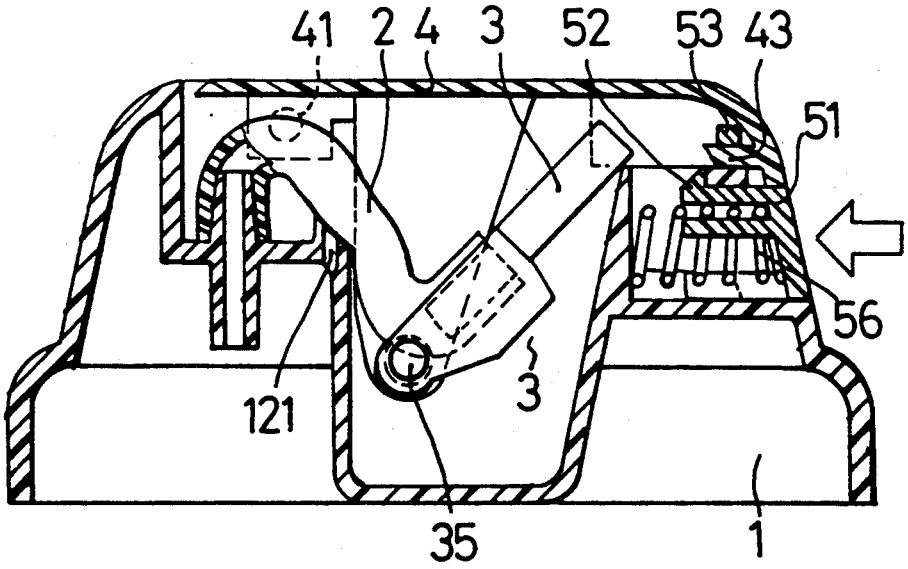
FIG. 2 is a side cross-sectional view of the water container cap of the present invention.
Figure 3:
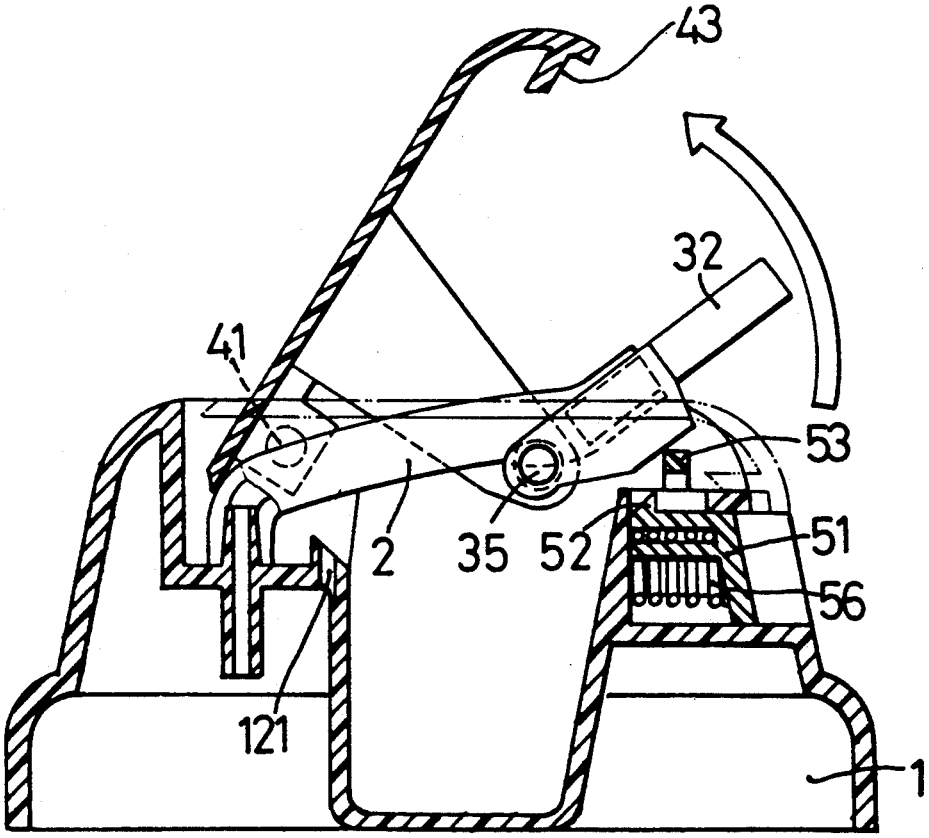
FIG. 3 is a side cross-sectional view showing the push button depressed and the cap member swung up to the open position in the water container cap of the present invention; and, FIG. 4 is a perspective view of the water container cap in the present invention.
Figure 4:
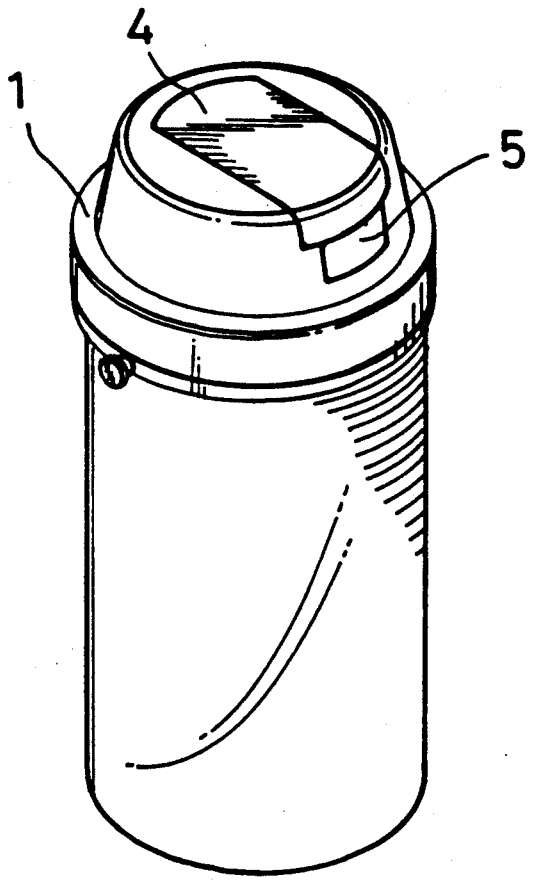

In using the cap, referring to FIGS. 2 and 3, the push button 5 is pushed inward within the opening 15, disengaging the block 43 of the cap member from the inverted U-shaped rod 53 of the push button 5, thereby permitting the nipple 3 supported between the two arms 42 of the cap member 4 to be pulled up by the arms 42, so that liquid in the water container to which the cap is installed can be sucked from the nipple 3. The post hole 121 in the cap body 1 functions as an air inlet, permitting air to flow into the water container, so that liquid therein may be withdrawn through the nipple 3. After finishing withdrawing water, all that is required is to push down the cap member 4, forcing the engaging block 43 to engage the inverted U-shaped rod 53 of the push button 5.

While the preferred embodiments of the invention have been described above, it will be recognized and understood that various modifications may be made therein and the appended claims are intended to cover all such modifications which may fall within the spirit and scope of the invention.

What is claimed is:

1. A cap for coupling to a water container, comprising:

a cap body having a recessed chamber disposed therein, said cap body having a pair of first recess openings formed in opposing side walls of said recessed chamber;

fluid coupling means extending through a bottom wall of said recessed chamber of said cap body for providing fluid communication with a fluid disposed within said water container;

vent means extending through said bottom wall of said recessed chamber of said cap body for providing an inlet for air as fluid is displaced from said water container;

nipple means fluidly coupled to said fluid coupling means for withdrawing fluid from said water container therethrough, said nipple means includes (1) a nipple support member having a substantially U-shaped contour, and (2) a nipple member extending through a central portion of said nipple support member and having a longitudinally directed bore hole extending therethrough, said nipple member having opposing first and second ends, said second end being coupled to one end of a flexible conduit, said flexible conduit having an opposing end coupled to said fluid coupling means;

closure means pivotedly coupled to said cap body for providing access to said nipple member, said closure means including a longitudinally extended cap member having a pair of opposing transversely directed first projections being disposed at one end thereof, each of said pair of first projections being disposed in a respective one of said pair of first recess openings for pivotally coupling said cap member to said cap body, whereby said cap member is rotatably displaceable from a first position to a second position, said cap member forming a closure for said recessed chamber in said first position, said closure means further including a pair of arm members extending from a bottom surface of said cap member in spaced parallel relation, said nipple support member being pivotally coupled to said pair of arm members for displacing said nipple member from a position within said recessed chamber of said cap body responsive to said cap member being displaced to said second position, whereby said first end of said nipple member is accessible to a user for withdrawing fluid from said water container therethrough; and, a push button member slidingly coupled within an opening formed opposite said recessed chamber of said cap body, said push button member having an inverted U-shaped rod defining a through opening on an upper portion thereof for reversibly capturing a lug extending from an end portion of said cap member and in spaced parallel relation with said bottom surface thereof, thereby maintaining said cap member in said first position when said lug is captured by said push button member, said cap being free to be displaced to said second position responsive to said push button member being slidingly displaced into said opening sufficiently to disengage said lug from said through opening formed in said push button member.

2. The cap as recited in claim 1 where said push button member having a longitudinally directed post extending from a closed end of said button member for locating one end of a spring member thereon, an opposing end of said spring member being disposed contiguous a closed end of said opening for resiliently biasing said push button member in position for engagement with said lug of said cap member.

* * * * *